US012059033B2

(12) United States Patent
Batista et al.

(10) Patent No.: US 12,059,033 B2
(45) Date of Patent: Aug. 13, 2024

(54) AEROSOL-GENERATING DEVICE WITH CLOSABLE CAVITY

(71) Applicant: PHILIP MORRIS PRODUCTS S.A., Neuchatel (CH)

(72) Inventors: Rui Nuno Batista, Morges (CH); Ricardo Cali, Mannheim (DE); Edward Kiernan, Le Mont-sur-Lasanne (CH)

(73) Assignee: Philip Morris Products S.A., Neuchatel (CH)

( * ) Notice: Subject to any disclaimer, the term of this patent is extended or adjusted under 35 U.S.C. 154(b) by 491 days.

(21) Appl. No.: 17/422,799

(22) PCT Filed: Jan. 15, 2020

(86) PCT No.: PCT/EP2020/050914
§ 371 (c)(1),
(2) Date: Jul. 14, 2021

(87) PCT Pub. No.: WO2020/148335
PCT Pub. Date: Jul. 23, 2020

(65) Prior Publication Data

US 2022/0132929 A1 May 5, 2022

(30) Foreign Application Priority Data

Jan. 15, 2019 (EP) ..... 19151923

(51) Int. Cl.
*A24F 40/46* (2020.01)
*A24F 40/20* (2020.01)

(52) U.S. Cl.
CPC ..... *A24F 40/46* (2020.01); *A24F 40/20* (2020.01)

(58) Field of Classification Search
CPC ..... A24F 40/46; A24F 40/20; A24F 40/40; A24F 40/00; A24D 1/20
See application file for complete search history.

(56) References Cited

U.S. PATENT DOCUMENTS

2018/0084828 A1 3/2018 Phillips
2018/0214645 A1 8/2018 Reevell

FOREIGN PATENT DOCUMENTS

GB 2 511 303 9/2014
WO WO 2017/167932 10/2017
(Continued)

OTHER PUBLICATIONS

PCT Search Report and Written Opinion for PCT/EP2020/050914 dated Apr. 6, 2020 (14 pages).
(Continued)

*Primary Examiner* — Jean F Duverne
(74) *Attorney, Agent, or Firm* — Mueting Raasch Group

(57) ABSTRACT

The invention relates to an aerosol-generating device comprising a main body and a top cover. The top cover comprising a cavity for removable insertion of an aerosol-generating article comprising aerosol-forming substrate. The aerosol-generating device further comprises a heater in the cavity. The top cover is configured as movable with respect to the main body between a first position and a second position. The cavity is accessible for insertion of the aerosol-generating article when the top cover is in the first position. The cavity is inaccessible for insertion of the aerosol-generating article when the top cover is in the second position. Movement of the top cover between the first and second position is caused by one or more of pivotal movement around, or transversal, to a longitudinal axis of the aerosol-generating device and sliding movement transversal to the longitudinal axis of the aerosol-generating device. The
(Continued)

invention also relates to a system comprising an aerosol-generating device and an aerosol-generating article.

12 Claims, 9 Drawing Sheets

(56) References Cited

FOREIGN PATENT DOCUMENTS

| | | | | |
|---|---|---|---|---|
| WO | WO 2018/050610 | 3/2018 | | |
| WO | WO 2018/224677 | 12/2018 | | |
| WO | WO-2019081602 A1 * | 5/2019 | ..... | A24F 40/20 |

OTHER PUBLICATIONS

Office Action issued in Japan for Application No. 2021-541139 dated Aug. 31, 2022 (8 pages). English translation included.

* cited by examiner

AEROSOL-GENERATING DEVICE WITH CLOSABLE CAVITY

This application is a U.S. National Stage Application of International Application No. PCT/EP2020/050914 filed Jan. 15, 2020, which was published in English on Jul. 23, 2020, as International Publication No. WO 2020/148335 A1. International Application No. PCT/EP2020/050914 claims priority to European Application No. 19151923.0 filed Jan. 15, 2019.

The present invention relates to an aerosol-generating device.

It is known to provide an aerosol-generating device for generating an inhalable vapor. Such devices may heat an aerosol-forming substrate without burning the aerosol-forming substrate. Such aerosol-forming substrates may be provided as part of an aerosol-generating article. Such devices may be arranged to receive an aerosol-generating article comprising an aerosol-forming substrate. The aerosol-generating article may have a rod shape for insertion of the aerosol-generating article into a cavity of the aerosol-generating device. A heater may be arranged in or around the cavity for heating the aerosol-forming substrate when the aerosol-generating article is inserted into the cavity of the aerosol-generating device. Conventional aerosol-generating devices may have a cavity, into which unwanted contamination can get during use of the device or when the device is not used, for example when the device stored or carried in a pocket of a user of the device. Additionally, in conventional aerosol-generating devices, the heater may get damaged during or after use. The heater may get damaged by a user or by unwanted elements unintentionally entering the cavity and mechanically damaging the heater.

It would be desirable to have an aerosol-generating device in which contamination of the cavity is reduced or eliminated and in which the heater is protected when the device is not used, e.g. carried around by a user in his or her pocket between usage sessions.

This and further objects of the invention are achieved by an aerosol-generating device comprising a main body and a top cover. The top cover comprising a cavity for removable insertion of an aerosol-generating article comprising aerosol-forming substrate. The top cover is configured as movable with respect to the main body between a first position and a second position. The cavity is accessible for insertion of the aerosol-generating article when the top cover is in the first position. The cavity is inaccessible for insertion of the aerosol-generating article when the top cover is in the second position. Movement of the top cover between the first and second position is caused by one or more of pivotal movement of the top cover around, or transversal, to a longitudinal axis of the aerosol-generating device and sliding movement of the top cover transversal to the longitudinal axis of the aerosol-generating device.

The two positions of the top cover enable operation and optimally prevent contamination of the cavity and damage to the heater, when the device is not operated. The cavity may be configured as a heating chamber. The first position of the top cover preferably is the position in which the aerosol-generating device may be operated. In the first position, the cavity is accessible so that an aerosol-generating device can be inserted into the cavity for heating the aerosol-forming substrate contained in the aerosol-generating article for aerosol generation. In the second position, the top cover is arranged such that the cavity is inaccessible. Preferably, the cavity is closed in the second position of the top cover. The second position of the top cover may correspond to a position, in which the device is not operated. The second position of the top cover may correspond to a position, in which the device may be stored. In the second position, the cavity may be sealed, preferably hermetically sealed.

According to one embodiment of the movement of the top cover, during movement from the first position to the second position and vice versa, the top cover may be configured as pivotably movable around a longitudinal axis of the aerosol-generating device.

According to one embodiment of the movement of the top cover, during movement from the first position to the second position and vice versa, the top cover may be configured as pivotably movable around an axis which is transversal to the longitudinal axis of the aerosol-generating device. In other words, in this embodiment, the top cover may be configured as pivotably movable around a transversal axis of the aerosol-generating device. This embodiment of the movement of the top cover is a preferred embodiment and will be denoted in the following as first embodiment.

According to one embodiment of the movement of the top cover, during movement from the first position to the second position and vice versa, the top cover may be configured as slidably movable transversal to the longitudinal axis of the aerosol-generating device. In other words, in this embodiment, the top cover may be configured as slidably movable along the transversal axis of the aerosol-generating device.

One or more of the above described embodiments of the movement of the top cover may be combined with each other. Preferably, during movement from the first position to the second position, the top cover may be configured as pivotably movable around the longitudinal axis of the aerosol-generating device and slidably movable transversal to the longitudinal axis of the aerosol-generating device. The top cover may be arranged in an intermediate position between the first position and the second position. This embodiment of the movement of the top cover is denoted in the following as the second embodiment.

The longitudinal axis of the aerosol-generating device may be an axis extending along the longitudinal length of the aerosol-generating device. The longitudinal axis may be parallel to the central longitudinal axis. Preferably, the longitudinal axis is identical to the central longitudinal axis. The central longitudinal axis may run through the center of gravity of the aerosol-generating device and along the longitudinal length of the aerosol-generating device. The longitudinal axis preferably lies in a vertical plane.

The term 'transversal to the longitudinal axis' may refer to an axis transversal to the longitudinal axis. In other words, the term 'transversal to the longitudinal axis' may refer to a transversal axis. The transversal axis preferably runs perpendicular to the longitudinal axis. The transversal axis preferably lies in a horizontal plane.

A pivotal movement may refer to a movement around an axis, preferably around the longitudinal axis, of the aerosol-generating device or around the transversal axis of the aerosol-generating device. During the pivotal movement, the distance towards the axis may essentially stay the same or exactly stay the same. During a pivotal movement, preferably no movement takes place along the length of the axis. During a pivotal movement, a rotational angle may change. According to the present invention, the pivotal movement preferably is a movement of 180°. The pivotal movement is preferably a movement to switch orientation of the top cover.

A sliding movement may refer to a movement along an axis. During a sliding movement, the distance towards the axis may essentially stay the same or exactly stay the same.

During a sliding movement, preferably a rotational angle does not change. During a sliding movement, preferably movement takes place along the length of the axis. The sliding movement may be parallel to the axis. Preferably, the sliding movement is on the axis.

The aerosol-generating device may further comprise a heater in the cavity.

In the first embodiment, in which the top cover may be configured as pivotably movable around the transversal axis of the aerosol-generating device, the heater is preferably accessible in the second position of the top cover.

In the second embodiment, in which the top cover may be configured as pivotably movable around the longitudinal axis of the aerosol-generating device and slidably movable along the transversal axis of the aerosol-generating device, the heater is preferably accessible in an intermediate position. In this regard, an intermediate position may be provided between the first position and the second position.

In the first embodiment and the second embodiment, the distal end of the cavity may be arranged adjacent the main body in the first position of the top cover such that the distal end of the cavity may be closed. The position of the distal end of the cavity may be different in the first embodiment and the second embodiment of the movement of the top cover.

As used herein, the terms 'upstream', 'downstream', 'proximal' and 'distal' may be used to describe the relative positions of components, or portions of components, of the aerosol-generating device in relation to the direction in which a user draws on the aerosol-generating device or an aerosol-generating article during use thereof. These terms are defined when the top cover is in the first position. For example, if reference is made to the distal end of the cavity, this reference refers to the distal end of the cavity, when the top cover is in the first position. When the top cover is in the second position, the end of the cavity denoted as distal end may in fact have rotated or moved in a proximal direction. However, still, this end will be denoted as distal end. In other words, the reference to specific elements will not change after movement of these elements.

In more detail, in the first embodiment, the distal end of the cavity may be pivotably moved or rotated in a proximal direction so that the distal end of the cavity is no longer arranged adjacent the main body in the second position of the top cover. Hence, in the first embodiment, the distal end of the cavity is accessible in the second position of the top cover.

In the second embodiment, the top cover is moved, during movement from the first position to the second position, towards an intermediate position. In this regard, initially the top cover is one or more of slidably moved along the transversal axis and pivotably moved around the longitudinal axis of the aerosol-generating device. Preferably, the initial movement is a sliding movement. This movement may facilitate movement of the top cover from the first position to the intermediate position. In the intermediate position, the distal end of the cavity is accessible. Subsequently, the top cover is moved from the intermediate position to the second position by a sliding or pivotal movement. Preferably, the subsequence movement is a pivotal movement. In the second position of the second embodiment of the movement of the top cover, the distal end of the cavity is no longer accessible due to the distal end of the cavity being arranged adjacent to the main body so that the main body blocks the distal end of the cavity.

The heater may be removable from and insertable into the cavity of the top cover, when the top cover is in the second position or in the intermediate position between the first and second position.

The second position in the first embodiment of the movement of the top cover, or the intermediate position in the second embodiment of the movement of the top cover, enables repair or replacement of the heater. Advantageously, the heater may be repaired or replaced without the need to repair or replace the whole aerosol-generating device or the whole top cover.

The cavity and the heater may be dimensioned such that the heater may be insertable into the cavity in a single specific orientation relative to the longitudinal axis of the device.

A keyed configuration may thus be achieved, which enables insertion of the heater into the cavity in a single way. Thus, it may be prevented that the user inserts the heater into the cavity in an unwanted orientation. For example, the cross-section of the heater or a mount of the heater may have an irregular or non-symmetric shape so as to enable the insertion of the heater into the cavity in a single specific orientation. Preferably, the cavity comprises an aperture for insertion of the heater, wherein the aperture may have a cross-section corresponding to the cross-section of the heater of the heater or the mount of the heater.

The heater may be removable from and insertable into the cavity from the distal end of the cavity.

The proximal end of the cavity, defined when the top cover is in the first position, may be configured for insertion of an aerosol-generating article containing aerosol-forming substrate. The distal end of the cavity may be arranged opposite the proximal end of the cavity. Configuring the cavity such that the heater is accessible from the distal end of the cavity may facilitate that a base or mount of the heater may be accessible. During repair or maintenance, a user may grip the base or mount of the heater without touching the part of the heater which gets heated. Thus, damaging of the heater may be prevented. Additionally, ease of removal of the heater may be facilitated.

The heater may comprise a protective shield. The protective shield may protect the heater during removal of the heater from the cavity and insertion of the heater into the cavity. The protective shield may be a porous lightweight protective body. The protection body may be made of any solid material such as a foil, plastics and other suitable material forming a large-pored mesh. The protective shield may be attached to the heater by a thread mechanism or any suitable mechanism. The protective shield may be mounted on the mount of the heater.

The protective shield may be at least partly extend along the full length of the heater, when the heater is removed from the cavity. Thus, repair or replacement of the part of the heater which gets heated may be facilitated, while the heater may be protected. For covering the heater, the protective shield may be dragged over the heater during removal of the heater. A protrusion or any other suitable element may be placed near the aperture at the distal end of the cavity for dragging or pushing the protective shield over the heater. Alternatively or additionally, a user may manually cover the heater with the protective shield.

One or more of the top cover and the main body may comprise a locking mechanism configured to lock the top cover in one or more of the first position and the second position.

The locking mechanism may comprise a mechanical locker. The locking mechanism may comprise a mechanical stopper. The locking mechanism may comprise a mechanical locker and a mechanical stopper. The locking mechanism may comprise a male part and the female part. The male part of the locking mechanism may be arranged at the main body of the aerosol-generating device. The female part of the locking mechanism may be arranged at the top cover of the aerosol-generating device. Alternatively, the male part of the locking mechanism may be arranged at the top cover and the female part of the locking mechanism may be arranged at the main body. The male part of the locking mechanism may have a spherical shape. The male part of the locking mechanism may be a solid ball. The female part of the locking mechanism may comprise a slot, into which the male part of the locking mechanism may fit. Alternatively, the male and female parts of the locking mechanism may be provided as dual metal springs. The locking mechanism may comprise a biasing element such as a spring to bias the male part of the locking mechanism towards the female part of the locking mechanism. The locking mechanism may be configured to hold the top cover the first position as well as in the second position. The locking mechanism may be configured such that the user may overcome a predetermined force to move the top cover out of the locking action of the locking mechanism. The locking mechanism may comprise a release mechanism such as a handle or a button, which may be utilized by a user to deactivate the locking action of the locking mechanism. The release mechanism of the locking mechanism may be a sliding mechanism. The sliding mechanism may be connected with a slidable handle operateable by a user. The sliding mechanism may be configured to lock the top cover in one or more of the first position and the second position. The sliding mechanism may comprise a protrusion, which may be slidable into a corresponding recess of one or more of the top cover and the main body. For example, the main body may comprise the sliding mechanism and the protrusion of the sliding mechanism may be slidable into a corresponding recess of the top cover to lock the position of the top cover with respect to the main body or vice versa. The locking mechanism may comprise a biasing element biasing the sliding mechanism towards the locking position.

The locking mechanism may comprise electrical leads to allow transfer of electrical energy from an electrical power supply in the main body to the top cover.

Within the top cover, electrical energy may flow towards and through the heater for operating the heater. The locking mechanism may be made from an electrically conductive material. Preferably, the male and the female parts of the locking mechanism may act as electrical leads for transferring electrical energy. The locking mechanism may be configured to only secure the top cover in the first position. If the top cover is secured to the first position, flow of electrical energy from the main body to the top cover may be enabled by the locking mechanism. The aerosol-generating device may be configured to be automatically operated, if flow of electrical energy is enabled from the main body to the top cover by means of the locking mechanism. Operation of the aerosol-generating device may refer to operation or activation of the heater of the aerosol-generating device. The locking mechanism may comprise a first part, which is configured to secure the top cover in the second position with respect to the main body. The first part of the locking mechanism may prevent electrical energy from flowing from the main body to the top cover. The aerosol-generating device may be configured to prevent operation of the aerosol-generating device, when no electrical energy flows from the main body to the top cover. Thus, the aerosol-generating device may be prevented from operation, when the top cover is in the second position. The locking mechanism may comprise a second part, which enables the flow of electrical energy from the main body to the top cover. The second part of the locking mechanism may be configured to secure the top cover in the first position. Hence, power may be saved, when the top cover is moved from the first position to the second position. Alternatively or additionally, energy efficiency may be optimized, when the top cover is arranged in the first position.

Alternatively to the locking means facilitating the flow of electrical energy from the main body to the top cover, an electrical contact may be arranged at the distal end of the cavity at the base or mount of the heater and at an opposite position at the main body. If the top cover is arranged in the first position, the electrical contact of the heater may contact the electrical contact of the main body. If the top cover is arranged in the second position, the electrical contacts of the heater and of the main body may be arranged distanced from each other such that flow of electrical energy from the main body to the heater is prevented. The electrical contacts may be configured as sliding contacts.

In the second embodiment of the movement of the top cover, when the top cover is at least slidably moved along the transverse axis of the aerosol-generating device, one or more of the top cover and the main body may comprise a groove for facilitating the sliding movement. The groove may limit the sliding movement. Preferably, the main body comprises a groove and the top cover comprises a protrusion such as a pin which is slidably arranged inside of the groove of the main body. For facilitating electrical contact between the main body and the top cover, an electrical spring contact may be arranged at a specific position at the groove of the main body. The electrical spring contact may be arranged at the position of the groove of the main body, at which the pin of the top cover is arranged, when the top cover is in the first position. In addition, the pin of the top cover may be configured as electrically conductive such that electrical energy may be transferred from the main body through the electrical spring contact through the pin of the top cover towards the heater arranged in the top cover. Instead of this arrangement, the top cover may comprise a corresponding groove and the main body may comprise a corresponding pin.

The aerosol-generating device may further comprise a biasing mechanism configured for biasing the top cover towards one or more of the first position and the second position.

The biasing mechanism may comprise a spring. The biasing mechanism may be arranged in the main body. The biasing mechanism may be arranged in the top cover. The biasing mechanism may be loaded in the first position of the top cover so as to bias the top cover from the first position towards the second position. However, preferably, the biasing mechanism may be loaded in the second position of the top cover to bias the top cover from the second position towards the first position. The locking mechanism may be provided for holding the top cover in the first position or in the second position or in the first position and of the second position. The locking mechanism may comprise a trigger mechanism such as a handle or button to release the top cover from the position in which the top cover was held by the locking mechanism. If a user wants to operate the device, the top cover, initially being in the second position, may be automatically moved to the first position by the biasing action of the biasing element when a user deactivates the locking mechanism.

The aerosol-generating device further may comprise a thread mechanism configured to enable the pivotal movement of the top cover.

The thread mechanism may comprise one or more first threads. Preferably, the thread mechanism comprises two first threads. The first threadsof the thread mechanism are preferably arranged on a shaft of the thread mechanism. The shaft of the thread mechanism is preferably arranged along, more preferably arranged on, the transversal axis of the aerosol-generating device. The thread mechanism may be connected, preferably is integrally formed, with the top cover. The top cover may be connected, preferably is integrally formed, with the shaft of the thread mechanism. The thread mechanism preferably comprises at least one, preferably two, moving parts. The moving parts preferably comprise second threads. The second threads of the moving parts are preferably configured as threads corresponding to the first threads of the thread mechanism. The first threads may be female threads and the second threads may be male threads or vice versa. If the moving parts of the third mechanism are moved along the transversal axis of the aerosol-generating device, the shaft is rotated. In other words, a translational movement of the moving parts may be converted to a rotational movement of the shaft. In the first position of the top cover, the moving parts are preferably arranged in an extended state, in which the moving parts are moved apart from each other. In the second position of the top cover, the moving parts are preferably arranged in a retracted state, in which the moving parts are moved towards each other. The moving parts may have an at least partially hollow shape to essentially encompass the top cover, if the top cover is in the second position. Preferably, the moving parts constitute the main body. Hence, in a second position, a compact element may be provided, in which the top cover cannot be seen. During movement of the top cover from the second position to the first position, the main body may be moved apart and the top cover may become visible and may be rotated at the same time.

The main body may comprise two elongations at the proximal end of the main body. The top cover may be arranged between the two elongations.

The two elongations are particularly preferred in the first embodiment of the movement of the top cover, in which the top cover is pivotably movable around the transversal axis of the aerosol-generating device. The two elongations may function as mounts for the top cover. The two elongations may comprise mounting elements such as shafts or pins for connecting the main body with the top cover. The mounting elements may be provided such that the top cover may be pivotably moved with respect to the main body. Preferably, two mounting points comprising two mounting elements are provided, wherein each of the two elongations comprise one mounting point and one mounting element. The axis connecting the two mounting points may be the transversal axis of the aerosol-generating device. The two elongations may comprise guiding rails along the length of inner side surfaces for optimizing the alignment of the main body with the top cover.

In each embodiment of the present invention, the aerosol-generating device may comprise mounting points and mounting elements, such as shafts or pins, between the main body and the top cover to facilitate the movement of the top cover relative to the main body.

The top cover of the aerosol-generating device may comprise a multipurpose cavity. The multipurpose cavity may be configured for storing of one or more of a cleaning tool and aerosol-generating articles. Preferably, the multipurpose cavity may be accessible, when the top cover is in one or more of the first position, the second position and the intermediate position. Most preferred, the multipurpose cavity may be accessible when the top cover is in the second position.

The cavity as described above preferably comprises the heater. The heater may comprise an electrically resistive material. Suitable electrically resistive materials include but are not limited to: semiconductors such as doped ceramics, electrically conductive ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese-, gold- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

The aerosol-generating device may comprise an internal heater or an external heater, or both internal and external heaters, where "internal" and "external" refer to the aerosol-forming substrate. An internal heater may take any suitable form. For example, an internal heater may take the form of a heating blade. Preferably, the internal heater is arranged within the cavity, more preferably centrally within the cavity. Alternatively, the internal heater may take the form of a casing or substrate having different electro-conductive portions, or an electrically resistive metallic tube. Alternatively, the internal heater may be one or more heating needles or rods that run through the center of the aerosol-forming substrate. Other alternatives include a heating wire or filament, for example a Ni—Cr (Nickel-Chromium), platinum, tungsten or alloy wire or a heating plate. Optionally, the internal heater may be deposited in or on a rigid carrier material. In one such embodiment, the electrically resistive heater may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the heaters during operation.

An external heater may take any suitable form. For example, an external heater may take the form of one or more flexible heating foils on a dielectric substrate, such as polyimide. The flexible heating foils can be shaped to conform to the perimeter of the cavity. Preferably, the external heater is arranged surrounding the cavity. Alternatively, an external heater may take the form of a metallic grid or grids, a flexible printed circuit board, a molded interconnect device (MID), ceramic heater, flexible carbon fibre heater or may be formed using a coating technique, such as plasma vapour deposition, on a suitable shaped substrate. An external heater may also be formed using a metal having a defined relationship between temperature and resistivity. In such an exemplary device, the metal may be formed as a track between two layers of suitable insulating materials. An external heater formed in this manner may be used to both heat and monitor the temperature of the external heater during operation.

The heater advantageously heats the aerosol-forming substrate by means of conduction. The heater may be at least partially in contact with the substrate, or the carrier on which the substrate is deposited. Alternatively, the heat from either an internal or external heater may be conducted to the substrate by means of a heat conductive element. The heater may also be configured as an induction heater. In this case, the heater may comprise susceptor material and an induction coil arranged surrounding the susceptor material. Preferably, the susceptor material has the form of a blade or pin is arranged as an internal heater, while the induction coil is arranged surrounding the susceptor material.

The heater may be part of the main body. Preferably, however, the heater is part of the top cover. Hence, the heater is preferably moved together with the top cover.

During operation, an aerosol-generating article containing the aerosol-forming substrate may be partially contained within the aerosol-generating device. In that case, the user may puff directly on the aerosol-generating article.

The cavity preferably has a cylindrical or tubular shape. The cavity preferably has a base. The base preferably has an opening, through which the heater may pass. The cavity may comprise a proximal end. The proximal end may be open for insertion of an aerosol-generating article. The distal end may comprise the base of the cavity. Alternatively, the cavity may have an open distal end. Preferably, the cavity has a cross-section corresponding to the cross-section of the aerosol-generating article to be used with the aerosol-generating device. For example, the cavity may have a cross-section to enable a keyed configuration, meaning that aerosol-generating articles may only be inserted in a specific way into the cavity.

As used herein, an 'aerosol-generating device' relates to a device that interacts with an aerosol-forming substrate to generate an aerosol. The aerosol-forming substrate may be part of an aerosol-generating article, for example part of a smoking article. An aerosol-generating device may be a smoking device that interacts with an aerosol-forming substrate of an aerosol-generating article to generate an aerosol that is directly inhalable into a user's lungs thorough the user's mouth. An aerosol-generating device may be a holder. The device may be an electrically heated smoking device.

As used herein, the term 'aerosol-generating article' refers to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable. A smoking article comprising an aerosol-forming substrate comprising tobacco may be referred to as a tobacco stick.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The aerosol-generating article may have a total length between approximately 30 mm and approximately 100 mm. The aerosol-generating article may have an external diameter between approximately 5 mm and approximately 12 mm. The aerosol-generating article may comprise a filter plug. The filter plug may be located at a downstream end of the aerosol-generating article. The filter plug may be a cellulose acetate filter plug. The filter plug is approximately 7 mm in length in one embodiment, but may have a length of between approximately 5 mm and approximately 10 mm.

In one embodiment, the aerosol-generating article has a total length of approximately 45 mm. The aerosol-generating article may have an external diameter of approximately 7.2 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm. The aerosol-generating article may comprise an outer paper wrapper. Further, the aerosol-generating article may comprise a separation between the aerosol-forming substrate and the filter plug. The separation may be approximately 18 mm, but may be in the range of approximately 5 mm to approximately 25 mm.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of an aerosol-generating article or smoking article.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds which are released from the substrate upon heating. Alternatively, the aerosol-forming substrate may comprise a non-tobacco material. The aerosol-forming substrate may further comprise an aerosol former that facilitates the formation of a dense and stable aerosol. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

As used herein, homogenised tobacco refers to material formed by agglomerating particulate tobacco. Homogenised tobacco may be in the form of a sheet. Homogenised tobacco material may have an aerosol-former content of greater than 5% on a dry weight basis. Homogenised tobacco material may alternatively have an aerosol former content of between 5% and 30% by weight on a dry weight basis. Sheets of homogenised tobacco material may be formed by agglomerating particulate tobacco obtained by grinding or otherwise combining one or both of tobacco leaf lamina and tobacco leaf stems. Alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Optionally, the solid aerosol-forming substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

In a particularly preferred embodiment, the aerosol-forming substrate comprises a gathered crimpled sheet of homogenised tobacco material. As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled. In certain embodiments, the aerosol-forming substrate may comprise a gathered sheet of homogenised tobacco material that is substantially evenly textured over substantially its entire surface. For example, the aerosol-forming substrate may comprise a gathered crimped sheet of homogenised tobacco material comprising a plurality of substantially parallel ridges or corrugations that are substantially evenly spaced-apart across the width of the sheet.

The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

The aerosol-generating device may comprise the electric circuitry. The electric circuitry may comprise a microprocessor, which may be a programmable microprocessor. The microprocessor may be part of a controller. The electric circuitry may comprise further electronic components. The electric circuitry may be configured to regulate a supply of power to the heater. Power may be supplied to the heater continuously following activation of the aerosol-generating device or may be supplied intermittently, such as on a puff-by-puff basis. The power may be supplied to the heater in the form of pulses of electrical current. The electric circuitry may be configured to monitor the electrical resistance of the heater, and preferably to control the supply of power to the heater dependent on the electrical resistance of the heater. The electric circuitry may be arranged in the main body. Preferably, the electric circuitry is configured to automatically supply electrical energy to the heater, when the top cover is in the first position. The electric circuitry may be configured to deactivate supply of electrical energy from the power supply to the heater, when the top cover is in the second position. The aerosol-generating device may comprise a detection element such as an electric switch to detect whether the top cover is in the first position. The detection element may be configured to detect every position of the top cover relative to the main body.

The aerosol-generating device may comprise a power supply, typically a battery, within the main body. As an alternative, the power supply may be another form of charge storage device such as a capacitor. The power supply may require recharging and may have a capacity that enables to store enough energy for one or more smoking experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the heater.

The invention also relates to an aerosol-generating system comprising an aerosol-generating device as described above and an aerosol-generating article comprising aerosol-forming substrate.

There is also provided a method for moving a top cover of an aerosol-generating device for accessing a cavity of the top cover, comprising:

Providing an aerosol-generating device comprising a main body and a top cover, the top cover comprising a cavity for removable insertion of an aerosol-generating article comprising aerosol-forming substrate into the cavity, the top cover being configured as movable with respect to the main body between a first position and a second position, wherein the cavity is accessible for insertion of the aerosol-generating article when the top cover is in the first position, the cavity being inaccessible for insertion of the aerosol-generating article when the top cover is in the second position, wherein movement of the top cover between the first and second position is caused by one or more of pivotal movement of the top cover around, or transversal, to a longitudinal axis of the aerosol-generating device and sliding movement of the top cover transversal to the longitudinal axis of the aerosol-generating device, and moving the top cover from the first position to the second position.

The method may comprise insertion of an aerosol-generating article in the cavity. The method may comprise heating of aerosol-forming substrate contained in an aerosol-generating article. The method may comprise aerosol generation. The method may comprise one or more of activation, operation and deactivation of the heater. The method may comprise removal of an aerosol-generating article from the cavity. The method may comprise removal of the heater via the distal end of the cavity. The method may comprise insertion of the heater via the distal end of the cavity.

The invention will be further described, by way of example only, with reference to the accompanying drawings in which.

FIG. 1 shows an aerosol-generating device comprising a top cover 10 and a main body 12. The top cover 10 comprises a cavity 14 for insertion of an aerosol-generating article 16 containing aerosol-forming substrate. The article 16 is for example shown in FIG. 4.

Figures 1A, 1B, 1C:
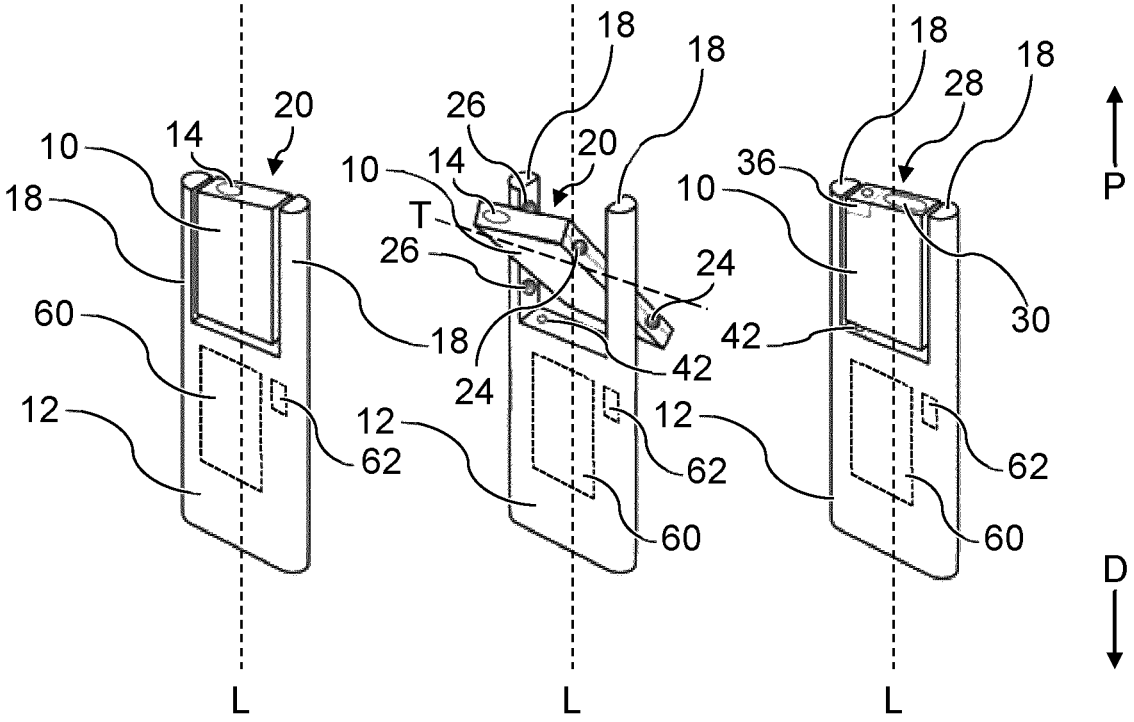
FIG. 1 shows a first embodiment of movement of a top cover of an aerosol-generating device with respect to a main body of the aerosol-generating device.

The top cover 10 of the aerosol-generating device is movable with respect to the main body 12 of the aerosol-generating device. For facilitating the movement of the top cover 10, FIG. 1 shows two elongations 18 arranged at a proximal end of the main body 12 and being arranged along the sides of the top cover 10. FIG. 1A, at the left of FIG. 1, shows the top cover 10 in a first position, in which the aerosol-generating device is operable. In this position, an aerosol-generating article 16 can be inserted into the cavity 14 for heating the aerosol-forming substrate contained in the aerosol-generating article 16 and for generating an inhalable aerosol.

In FIG. 1B, the beginning of a movement of the top cover 10 is indicated, wherein the top cover 10 is moved from the first position towards a second position. The top cover 10 is rotated. In other words, the top cover 10 is pivotably moved around a transversal axis T of the aerosol-generating device. The transversal axis T is perpendicular to the longitudinal axis L of the aerosol-generating device. As can be seen in FIG. 1B, a locking mechanism 22 (more clearly shown in FIGS. 5 and 7) is provided comprising a male part 24 configured as a sphere and a female part 26 configured as a slot. The male part 24 comprises four spheres and the female part 26 comprises four slots. Each of the two elongations 18 comprises two parts of the locking mechanism 22. The different parts of the locking mechanism 22 are arranged spaced apart from each other so as to increase the locking action of the top cover 10 with respect to the main body 12, when the top cover 10 is arranged in the first position or in the second position.

FIG. 1C shows that the top cover 10 has reached the second position. Thus, the top cover 10 has been fully rotated by 180° so that a distal end 28 of the top cover 10 is now oriented towards a proximal direction P and the proximal end 20 of the top cover 10 is now oriented towards the distal direction D. The naming convention of the ends of the top cover 10 is based on the orientation of the top cover 10 in the first position and is retained independently of the orientation of the top cover 10, when the top cover 10 is moved to the second position. As can be seen in FIG. 1C, the distal end 28 of the top cover 10, which is for the first time visible in FIG. 1C, comprises a multipurpose cavity 30 for storing of aerosol-generating articles 16 or of elements such as a cleaning tool. Additionally, the distal end 28 of the top cover 10 comprises an aperture 32 for removal and insertion of a heater 34 of the aerosol-generating device (see e.g. FIG. 2). The heater 34 is thus arranged in the top cover 10 and rotated together with the top cover 10.

Figure 2:
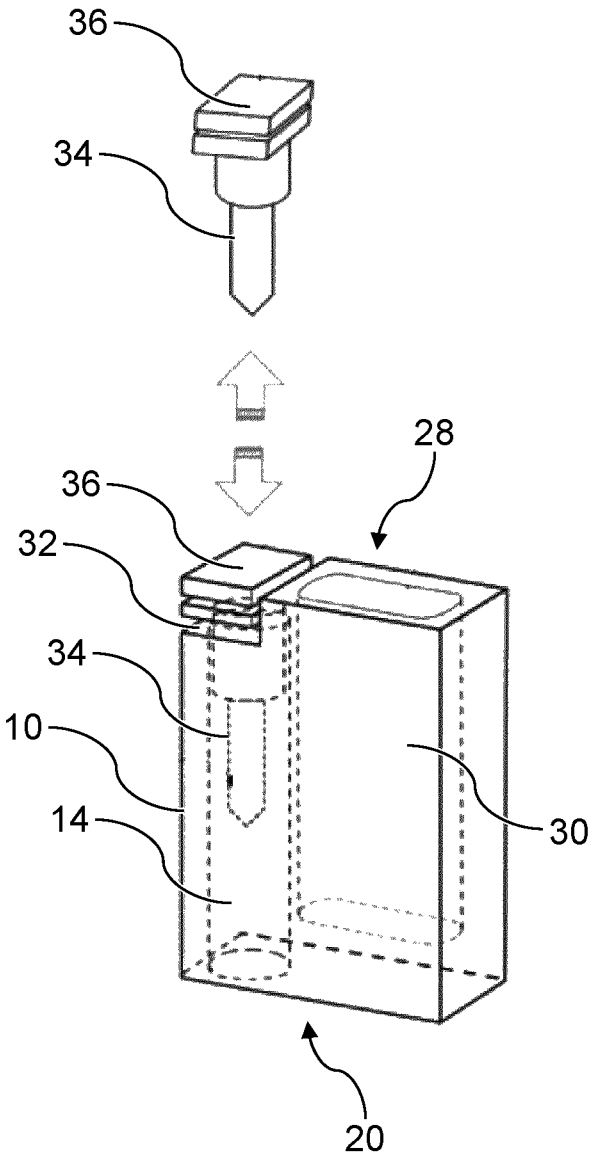
FIG. 2 shows insertion of the heater into a cavity of the top cover.

FIG. 2 shows the top cover 10 and the heater 34, wherein the heater 34 is inserted into the cavity 14 of the top cover 10 at the distal end 28 of the top cover 10. The heater 34 comprises a part which is heated. This part is blade-shaped. In addition, the heater 34 comprises a mount 36. The mount 36 may be placed adjacent to the base of the heater 34. The mount 36 may be configured for attachment of the heater 34 to the mount 36. The mount 36 may be configured for enabling flow of electrical energy towards the heater 34. If the top cover 10 is rotated towards the second position as depicted in FIG. 1D, the heater 34 can easily be removed from the top cover 10 for repair or replacement. A repaired or replaced heater 34 can easily be inserted into the cavity 14. The top cover 10 can then be rotated back towards the first position for operation. Additionally, the second position could be used to prevent unwanted contamination of the cavity 14 or the part of the heater 34, which is heated. Hence, the second position of the top cover 10 could be used for storing the aerosol-generating device.

Figure 3:
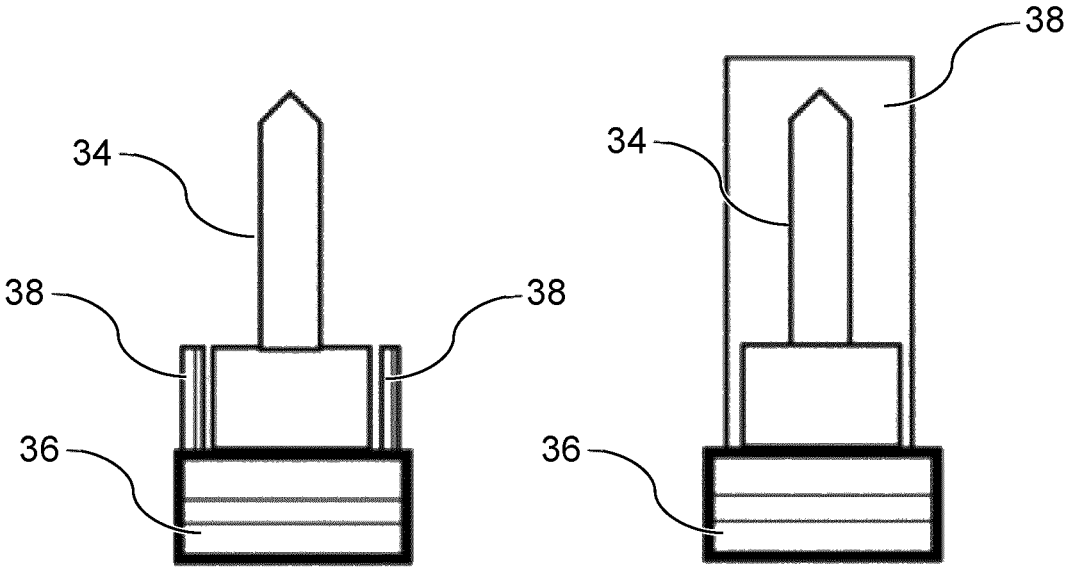
FIG. 3 shows a cross-sectional view of a protective shield for the heater.

FIG. 3 shows a cross-sectional view of the heater 34. Particularly, in addition to the blade-shaped part of the heater 34 which is heated and the mount 36 of the heater 34, a protective shield 38 of the heater 34 is depicted. In the left part of FIG. 3, the protective shield 38 is depicted in a retracted state. This state may be the state of the protective shield 38, when the heater 34 has been inserted into the cavity 14 of the top cover 10. Thus, the protective shield 38 may be retracted in this state from the part of the heater 34 that is heated so that an aerosol-generating article 16 can be inserted into the cavity 14 and so that the part of the heater 34 which is heated can penetrate the aerosol-forming substrate contained in the aerosol-forming article. In the right part of FIG. 3, the protective shield 38 is depicted in an extended state. The protective shield 38 of the heater 34 may be in the extended state, when the heater 34 is removed from the cavity 14 of the top cover 10. Thus, at least the part of the heater 34, which is heated, may be protected by the protective shield 38, when the heater 34 is removed from the cavity 14. This may particularly be beneficial to prevent damage to the heater 34 during or after removal of the heater 34 from the cavity 14.

Figure 4:
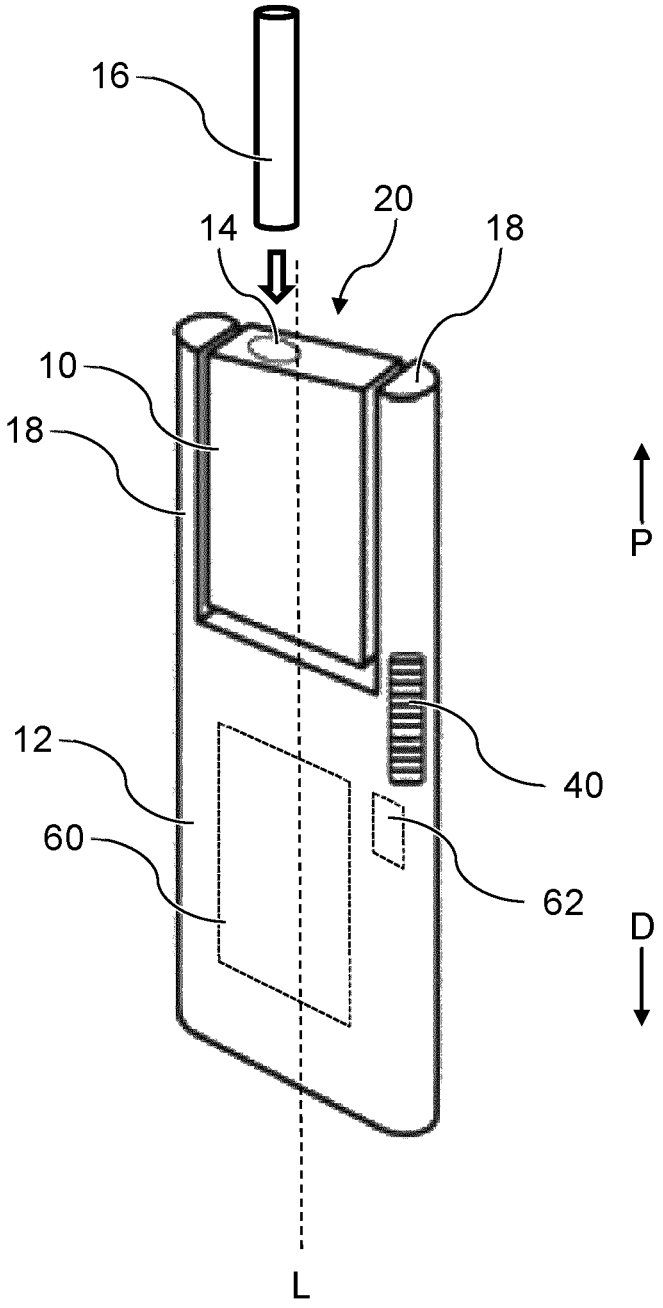
FIG. 4 shows a handle for securing the top cover in a first position or a second position.

FIG. 4 shows a handle 40 of a second locking mechanism 42 for locking the top cover 10 in one or more of the first position and the second position.

Figure 5:
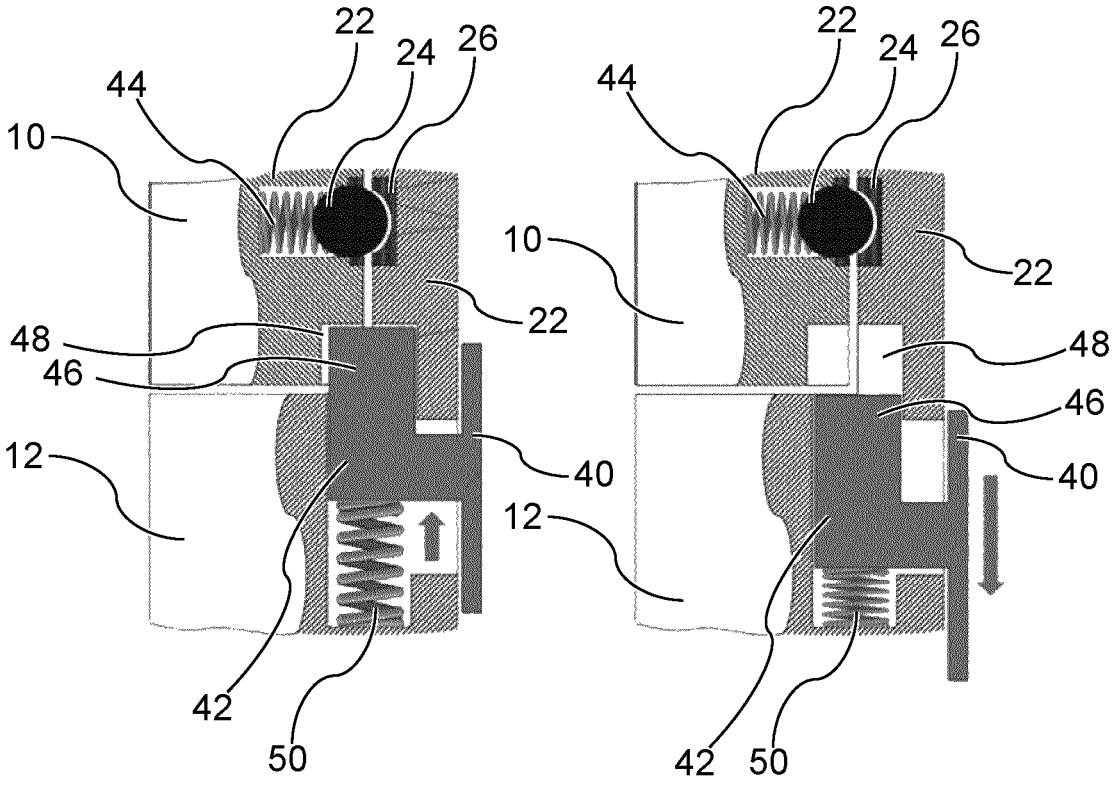
FIG. 5 shows a cross-sectional view of a locking mechanism.

FIG. 5 shows a cross-sectional view of the first locking mechanism 22 as well as the second locking mechanism 42. The first locking mechanism 22 comprises a male part 24, which comprises a sphere. In addition, the first locking mechanism 22 comprises a female part 26, which comprises a slot. These parts of the first locking mechanism 22 have already been discussed in connection with FIG. 1. As can additionally be seen in FIG. 5, the male part 24 comprises a spring 44, which biases the sphere towards the female part 26 so as to facilitate a secure connection between the male part 24 and the female part 26. As indicated in FIG. 1, multiple, preferably four, pairs of male and female parts may be provided in the first locking mechanism 20.

Additionally, FIG. 5 shows a second locking mechanism 42 in the form of a sliding mechanism for securely holding the top cover 10 in one or more of the first position and the second position. The sliding mechanism shown in FIG. 5 is provided in addition or alternatively to the male and female parts of the first locking mechanism 22. The sliding mechanism may be manually operated by a user, particularly by the handle 40 shown in FIG. 4. The handle 40 may be configured as a sliding handle 40 for sliding a projection 46 shown in FIG. 5 of the sliding mechanism into a corresponding recess 48 arranged in the top cover 10. The projection 46 is biased by a biasing element 50 in the form of a spring towards the recess 48. Hence, a user may manually disengage the projection 46 from the recess 48 to enable movement of the top cover 10. Preferably, the sliding mechanism shown in FIG. 5 is provided on the distal end 28 of the top cover 10 so as to facilitate secure holding of the top cover 10 in the first position such that an aerosol-generating article 16 can be inserted into the cavity 14 of the top cover 10 without unwanted movement of the top cover 10. However, of course a corresponding sliding mechanism, particularly a recess 48, could additionally or alternatively be provided at the proximal end 20 of the top cover 10 so as to facilitate secure holding of the top cover 10 in the second position.

In all embodiments discussed herein, a biasing element, preferably a spring, may be provided for biasing the top cover 10 towards one or more of the first position and the second position. If a user disengages the handle 40, the top cover 10 may automatically move from the first position to the second position due to the biasing action of this biasing element.

Figures 6A, 6B, 6C:
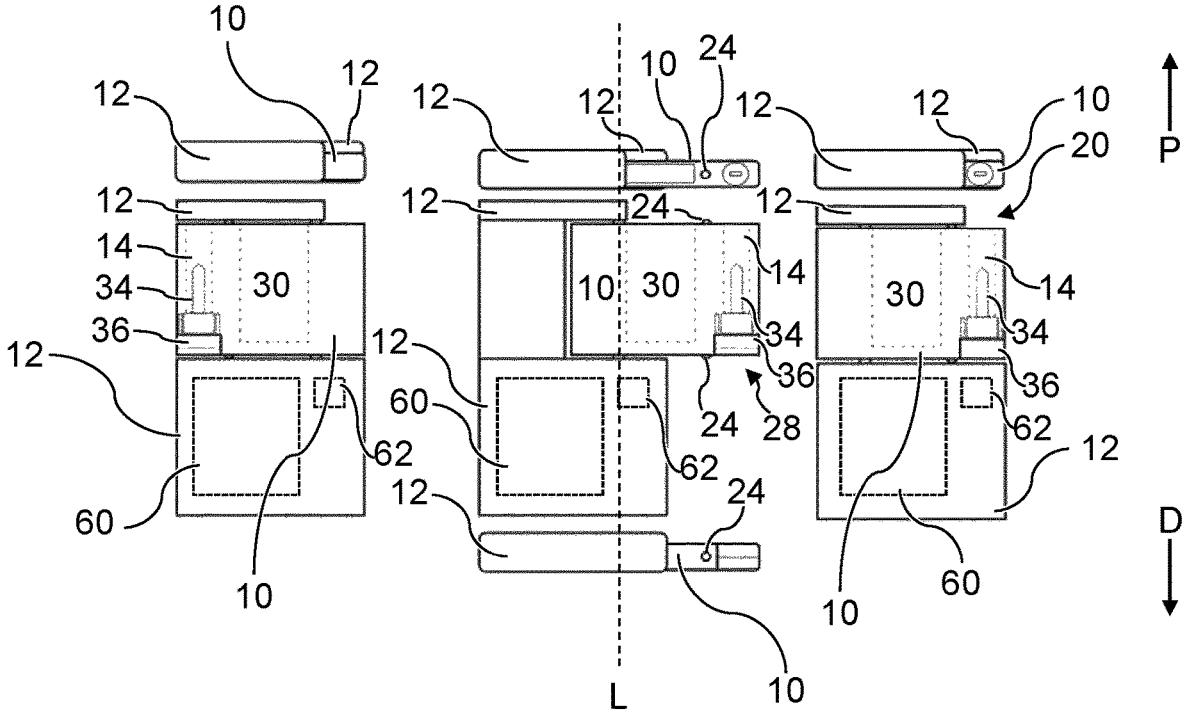
FIG. 6 shows a second embodiment of movement of the top cover of the aerosol-generating device with respect to the main body of the aerosol-generating device.

FIG. 6 shows a second embodiment of movement of the top cover 10. In the embodiment shown in FIG. 6A, the top cover 10 is in the second position. In this position, the proximal end 20 as well as the distal end 28 of the heating cavity 14 are protected by the main body 12. Hence, the cavity 14 is protected from unwanted contamination. Additionally, damaging of the heater 34 is prevented. The top part of FIGS. 6A to 6C show the aerosol-generating device from the top. The middle part of FIG. 6, FIG. 6B, shows a first movement, in which the device is moved from the second position to an intermediate position. The bottom part of FIG. 6B shows the aerosol-generating device from the bottom. The middle parts of FIG. 6 show the aerosol-generating device from the side. The movement from the second position to the intermediate position is facilitated by a pivotal movement of the top cover 10 around the longitudinal axis L of the aerosol-generating device. In the embodiment depicted in FIG. 6, the longitudinal axis L is parallel to the central longitudinal axis of the aerosol-generating device. The longitudinal axis L may also be identical to the central longitudinal axis. In the embodiment shown in FIG. 6, the longitudinal axis L is preferably the central longitudinal axis L. The pivotal movement shown in FIG. 6 is facilitated by a pin 52 (shown in FIG. 7) arranged at the proximal end 20 and at the distal end 28 of the top cover 10, which extends into a corresponding groove 54 of the main body 12. The pin 52 and the groove 54 are described in more detail below with respect to FIGS. 7 and 8. In the intermediate position of the top cover 10, shown in FIG. 6B, the cavity 14 is accessible. Hence, an aerosol-generating article 16 may be inserted into the cavity 14. Additionally or alternatively, the heater 34 may be removed through the distal end 28 of the cavity 14 for repair or replacement. A repaired or replaced heater 34 may be inserted through the distal end 28 of the cavity 14 into the cavity 14. Preferably, in all embodiments described herein, the heater 34 may only be removed from and inserted into the cavity 14 through the distal end 28 of the cavity 14. In FIG. 6C, the top cover 10 is shown in the first position, in which the aerosol-generating device is operable. In this position of the top cover 10, the cavity 14 of the top cover 10 is still accessible from the proximal end 20 such that an aerosol-generating article 16 may be inserted into the cavity 14 arranged at the proximal end 20. However, the distal end 28 of the cavity 14 is closed by the main body 12 so that the heater 34 is protected. Preferably, the intermediate position as shown in FIG. 6B is utilized to enable access to the heater 34, while the first position shown in FIG. 6C is shown as operating position for inserting an aerosol-generating article 16 into the cavity 14 and for operating the device.

Figure 7:
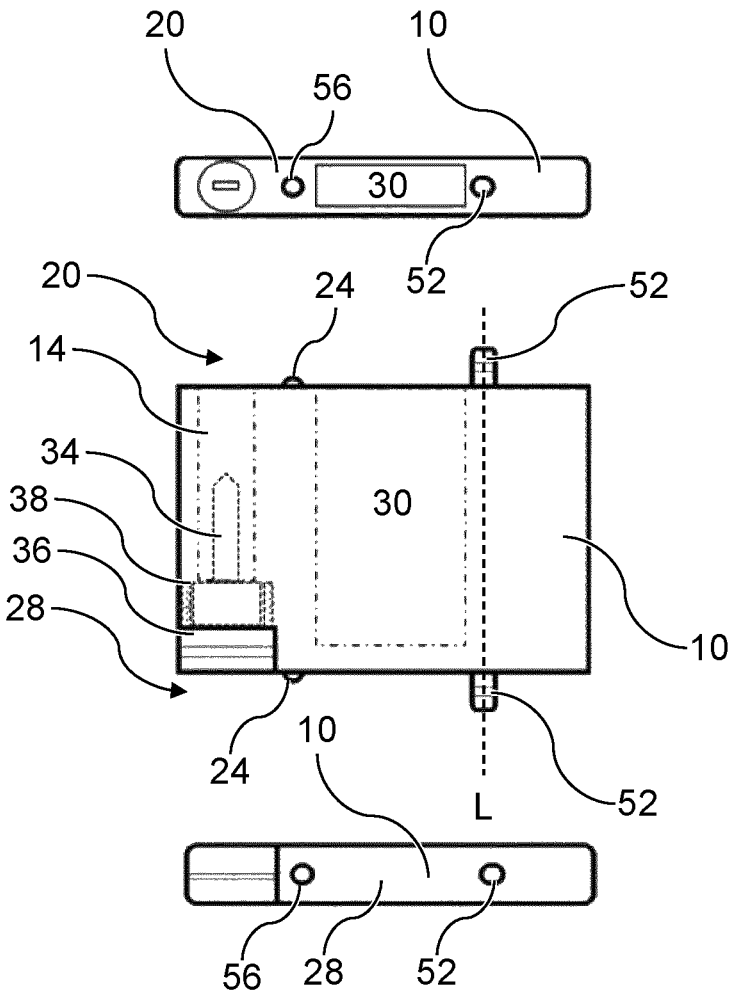
FIG. 7 shows the top cover for facilitating the second embodiment of movement of the top cover.
Figure 8:
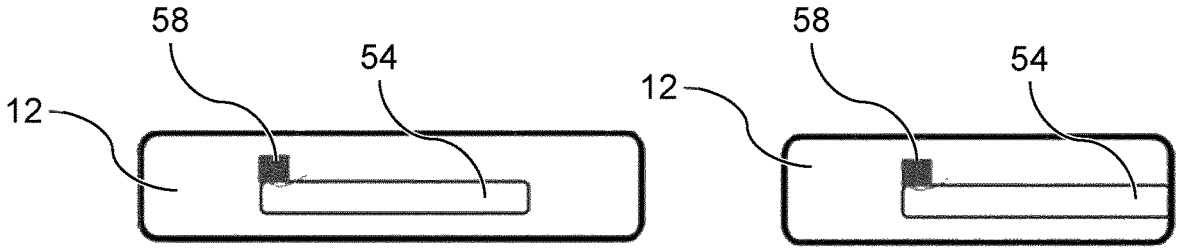
FIG. 8 shows a further view of the top cover for facilitating the second embodiment of movement of the top cover.

FIG. 7 shows the top cover 10 according to the embodiment shown in FIG. 6 in more detail. The top part of FIG. 7 shows the aerosol-generating device from the top, the middle part of FIG. 7 shows the aerosol-generating device form the side, similar to the middle parts of FIG. 6, and the bottom part of FIG. 7 shows the aerosol-generating device from the bottom. FIG. 7 shows that the top cover 10 comprises a pin 52 at the distal end 28 as well as at the proximal end 20 of the top cover 10. The pin 52 may be arranged or arrangeable within a corresponding groove 54 of the main body 12, which is depicted in FIG. 8 and discussed below. In addition to the pin 52, FIG. 7 also shows a locking mechanism 56, similar to the first locking mechanism 22 as described above, for securing the position of the top cover 10 in the first position and in the second position with respect to the main body 12.

FIG. 8 shows the groove 54 of the main body 12 utilized in the embodiment shown in FIGS. 6 and 7. The groove 54 of the main body 12 is configured such that the pin 52 of the top cover 10 shown in FIG. 7 can be inserted into the groove 54. The left part of FIG. 8 shows the bottom part of the main body 12, while the right part of FIG. 8 shows the top part of the main body 12 as depicted in FIG. 6. In addition to the groove 54, FIG. 8 shows an electrical spring contact 58, which is arranged at an end of the groove 54 so that electrical contact between the main body 12 and the top cover 10 may be facilitated in the first position of the top cover 10. In this regard, the pin 52 is preferably configured as electrically conductive so that the pin 52 together with the electrical spring contact 58 may facilitate the electrical contact between the main body 12 and the top cover 10. Preferably, two pins 52 are arranged, one at the proximal end 20 of the top cover 10 and one at the distal end 28 of the top cover 10. Consequently, preferably two grooves 54 are arranged, one at the top part of the main body 12 and one at the bottom part of the main body 12. Additionally, preferably two electrical spring contacts 58 are provided, one in the groove 54 of the top part of the main body 12 and one at the proof of the bottom part of the main body 12. Of course, instead of the main body 12 comprising the groove 54 and the top cover 10 comprising the pin 52, the top cover 10 could comprise the groove 54 and the main body 12 could comprise the pin 52. In this way, flow of electrical energy from a power source 60 of the aerosol-generating device towards the heater 34 may be facilitated. The flow of electrical energy may be controlled by electric circuitry 62. The power source 60 and the electric circuitry 62 are preferably arranged in the main body 12. Due to the heater 34 being arranged separate from the power source 60 and the electric circuitry 62, one or more of the power source 60 in the electric circuitry 62 may be overmolded so as to increase longevity of these elements.

Figure 9:
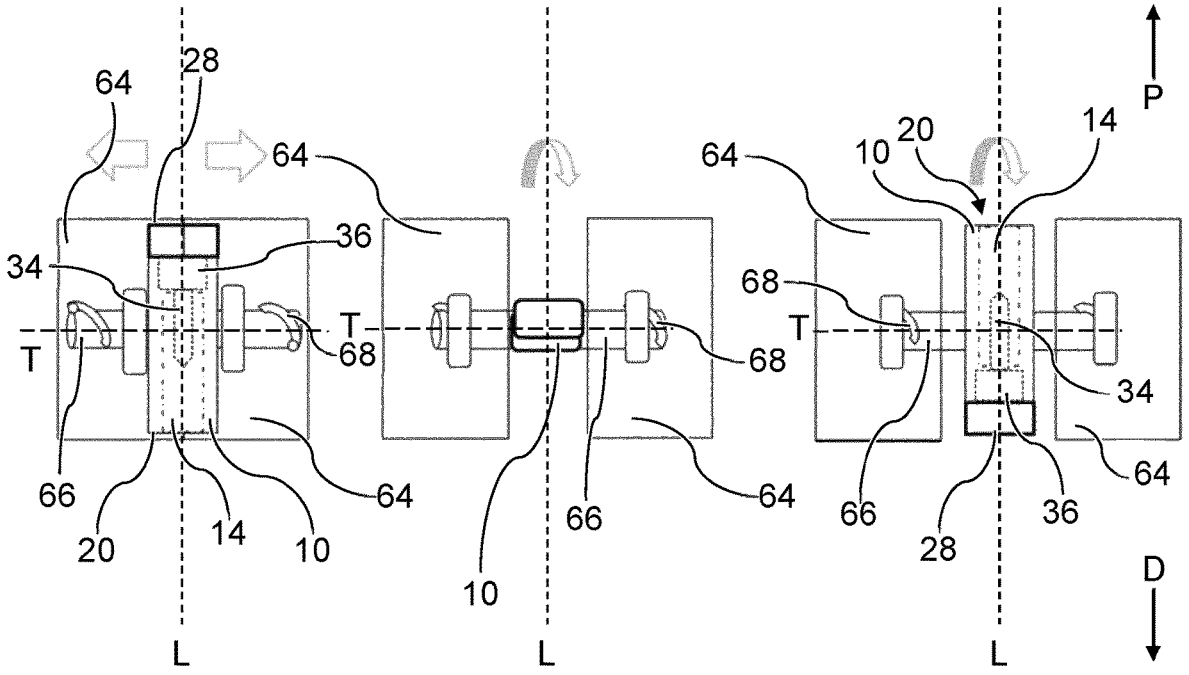
FIG. 9 shows a second configuration for realizing the first embodiment of movement of the top cover of the aerosol-generating device with respect to the main body of the aerosol-generating device.

FIG. 9 shows a further configuration of the first embodiment of movement of the top cover 10 by means of a thread mechanism. In this regard, the left part of FIG. 9 shows a configuration, in which the main body 12 comprises two movable parts 64. The two movable parts 64 are connected with a shaft 66. The shaft 66 comprises first threads 68. The top cover 10 is connected to the shaft 66 and rotated as a reaction of the shaft 66 being rotated. In addition, the movable parts 64 comprise second threads, which engage with the first threads 68. If the movable parts 64 are moved apart from each other, as can be seen in the middle part and the right part of FIG. 9, the top cover 10 is automatically rotated by 180°. Hence, the transition from the first position to the second position of the top cover 10 can be realized in the configuration shown in FIG. 9 by moving the moving parts 64 together and apart from each other. This configuration may have the advantage that in the position shown in the left of FIG. 9, the top cover 10 may be protected from damage or contamination, since the top cover 10 may be at least partially, preferably fully, surrounded by the moving parts 64 constituting the main body 12.

The invention claimed is:

1. Aerosol-generating device comprising:

a main body;

a top cover, the top cover comprising a cavity for removable insertion of an aerosol-generating article comprising aerosol-forming substrate; and a heater in the cavity, the top cover being configured as movable with respect to the main body between a first position and a second position, wherein the cavity is accessible for insertion of the aerosol-generating article when the top cover is in the first position, the cavity being inaccessible for insertion of an aerosol-generating article when the top cover is in the second position, wherein one or more of the top cover and the main body comprises a locking mechanism configured to lock the top cover in one or more of the first position and the second position, wherein the locking mechanism comprises electrical leads to allow transfer of electrical energy from an electrical power supply in the main body to the top cover, wherein movement of the top cover between the first and second position is caused by one or more of:

pivotal movement of the top cover around, or transversal to, a longitudinal axis of the aerosol-generating device, and sliding movement of the top cover transversal to the longitudinal axis of the aerosol-generating device.

2. Aerosol-generating device according to claim 1, wherein the heater is removable from and insertable into the cavity of the top cover, when the top cover is in the second position or an intermediate position between the first and second position.

3. Aerosol-generating device according to claim 1, wherein the cavity and the heater are dimensioned such that the heater is insertable into the cavity in a single specific orientation relative to the longitudinal axis of the device.

4. Aerosol-generating device according to claim 1, wherein the heater is removable from and insertable into the cavity from a distal end of the cavity.

5. Aerosol-generating device according to claim 1, wherein the heater comprises a protective shield.

6. Aerosol-generating device according to claim 5, wherein the protective shield at least partly extends along a full length of the heater, when said heater is removed from the cavity.

7. Aerosol-generating device according to claim 1, wherein the aerosol-generating device further comprises a biasing mechanism configured for biasing the top cover towards one or more of the first position and the second position.

8. Aerosol-generating device according to claim 1, wherein the aerosol-generating device further comprises a thread mechanism configured to enable the pivotal movement of the top cover.

9. Aerosol-generating device according to claim 8, wherein the thread mechanism is configured to enable a translational movement of the top cover.

10. Aerosol-generating device according to any claim 1, wherein the main body comprises two elongations at a proximal end of the main body, wherein the top cover is arranged between the two elongations, and wherein the top cover is pivotably movable transversal to the longitudinal axis of the aerosol-generating device.

11. Aerosol-generating device according to claim 1, wherein the top cover is, during movement from the first position to the second position, configured as pivotably movable around the longitudinal axis of the aerosol-generating device and slidably movable transversal to the longitudinal axis of the aerosol-generating device.

12. Aerosol-generating system comprising an aerosol-generating device according to claim 1 and an aerosol-generating article comprising aerosol-forming substrate.

* * * * *